US006112945A

United States Patent [19]

Woods

[11] Patent Number: 6,112,945

[45] Date of Patent: Sep. 5, 2000

[54] AEROSOL VALVE ASSEMBLY FOR SPRAYING VISCOUS MATERIALS OR MATERIALS WITH LARGE PARTICULATES

[75] Inventor: John R. Woods, Woodland Hills, Calif.

[73] Assignee: Spraytex, Inc., Calabasas, Calif.

[21] Appl. No.: 09/312,133

[22] Filed: May 14, 1999

[51] Int. Cl.[7] ..... G01F 11/00

[52] U.S. Cl. ..... 222/1; 222/402.25; 222/464.5

[58] Field of Search ..... 222/1, 402.1, 402.24, 222/402.25, 464.1, 464.3, 464.5

[56] References Cited

U.S. PATENT DOCUMENTS

| | | | |
|---|---|---|---|
| 3,206,078 | 9/1965 | Leimegger | 222/464.1 |
| 3,806,004 | 4/1974 | Kolkovsky | 222/464.5 |
| 4,220,258 | 9/1980 | Gruenewald | 222/402.25 |
| 5,450,983 | 9/1995 | Stern et al. | 222/402.25 |
| 5,842,076 | 9/1998 | Glover et al. | 222/464.1 |

*Primary Examiner*—Joseph A. Kaufman
*Attorney, Agent, or Firm*—Pillsbury Madison & Sutro LLP

[57] ABSTRACT

A valve assembly is disclosed for use in an aerosol spray can capable of spraying viscous materials or materials with large particulates without clogging or packing like traditional aerosol spray cans designed for spraying texture materials. The valve opening is located at the bottom of the container rather than at the top, thus allowing highly-viscous materials, such as a fire suppressant material, or materials having large particulates, such as stucco, to be sprayed from an aerosol spray can without clogging of the valves. The valve assembly can spray materials that more closely resemble the original surface texture found on textured and stucco-covered walls and ceilings of buildings and structures.

17 Claims, 8 Drawing Sheets

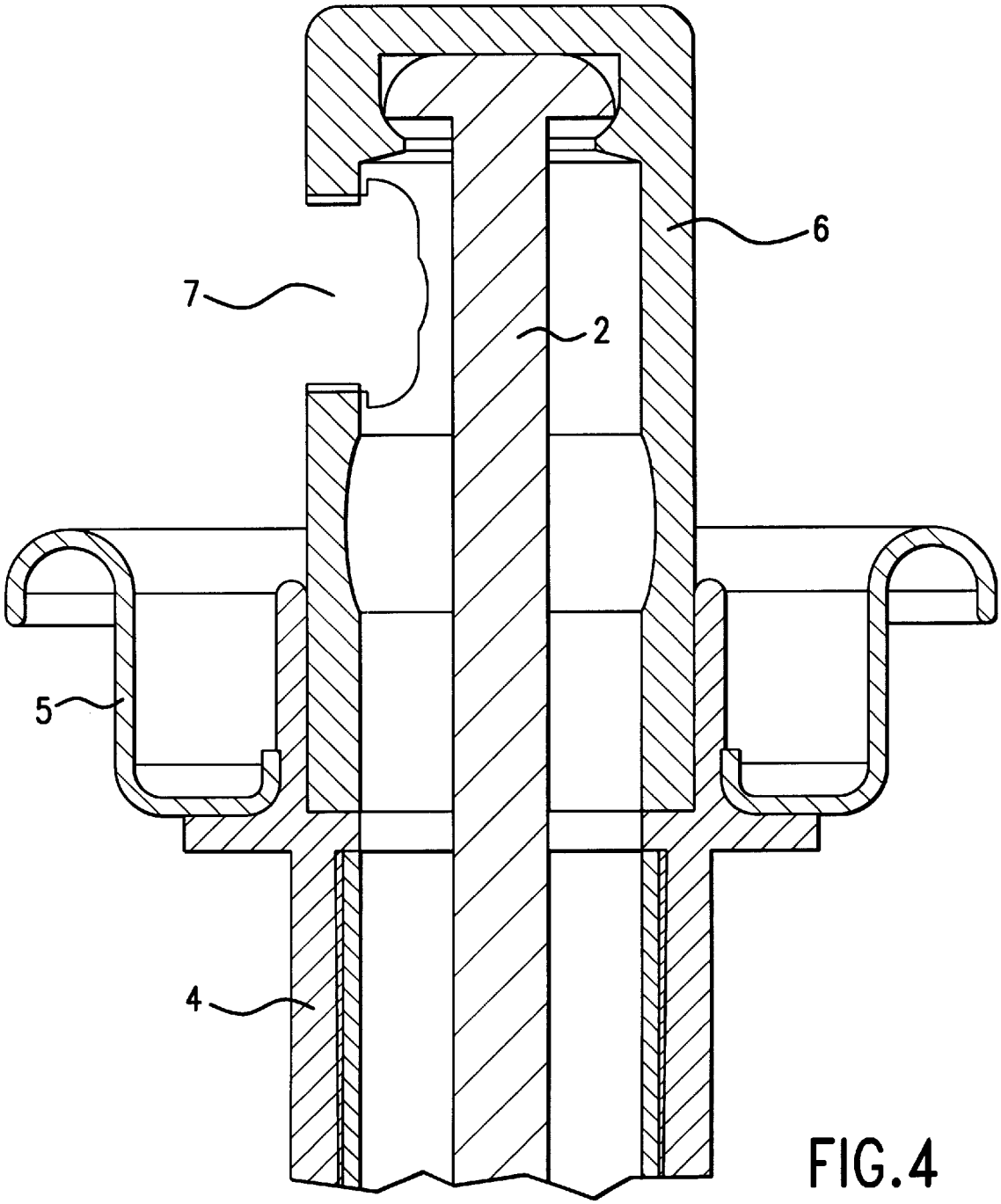
FIG.4
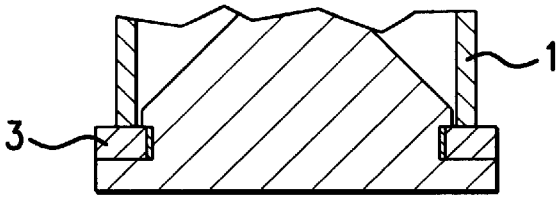

AEROSOL VALVE ASSEMBLY FOR SPRAYING VISCOUS MATERIALS OR MATERIALS WITH LARGE PARTICULATES

FIELD OF INVENTION

This invention relates to a valve assembly for use in an aerosol spray can capable of spraying viscous materials or materials with large particulates without clogging or packing like traditional aerosol spray cans designed for spraying texture materials.

BACKGROUND OF THE INVENTION

The practice of dispensing heavy and particulate materials through traditional aerosol spray can valve assemblies in the aerosol industry has presented problems in which the heavy and particulate materials to be dispersed clog up the valve assemblies. These heavy and particulate materials may include exterior stucco, heavy sand finishes, drywall and acoustic ceiling patching materials, fire suppressant materials, adhesive and bonding materials, and even culinary sauces.

A traditional aerosol spray can may be filled with these heavy and particulate materials for spraying. However, because of the placement of the valve assembly in traditional aerosol spray cans, these heavy and particulate materials will clog up the valve assemblies and render the aerosol spray cans inoperative. Constant operation of these aerosol spray cans in spraying heavy and particulate materials is not possible due to the inconsistent ability of these traditional valve assemblies to dispense these materials without clogging.

U.S. Pat. No. 5,715,975, issued to Stem et al., discloses an aerosol spray texturing device that is comprised of a container, a nozzle, a valve assembly, and an outlet. The valve assembly in the '975 patent is located in the upper section of the container near the nozzle. Although the nozzle tube of the device in the '975 patent may be configured to spray texture materials, the device in the '975 patent still has the problem of clogging or packing of the valve assembly by the particulates contained in the texture material for spraying, especially if the particulates are large, like those found in stucco or other heavy and particulate materials mentioned above.

U.S. Pat. No. 5,037,011, issued to the present Applicant, discloses a spray apparatus for spraying a texture material through a nozzle. Similarly in this apparatus, there too exists a problem of spraying texture materials having large particulates, such as stucco, because the particulates also clog up the valve opening within the spray apparatus.

Therefore, a long-standing need has existed to provide an apparatus that may be used to readily apply heavy and particulate materials in aerosol form, such as exterior stucco, heavy sand finishes, drywall and acoustic ceiling patching materials, fire suppressant materials, adhesive and bonding materials, and culinary sauces. Furthermore, the heavy and particulate materials to be applied should be contained in a hand-held applicator so that the materials may be conveniently stored, as well as dispensed in a simple and convenient manner without clogging or packing the valve assembly of the applicator.

SUMMARY OF THE INVENTION

An object of the present invention is to provide a valve assembly for use in an aerosol spray can capable of spraying viscous materials or materials with large particulates without clogging or packing like traditional aerosol spray cans designed for spraying texture materials.

Another object of the present invention is to provide an inexpensive and economical means for matching surface texture of a repaired or patched surface area on a drywall panel, acoustic ceiling, or stucco-covered surface.

Another object of the present invention is to improve the appearance of patched or repaired areas on a textured surface by employing a spray-on hardenable texture material that covers the repaired or patched area and visually assumes the surface texture of the surrounding patched or repaired surface.

Another object of the present invention is to provide a hand-held dispensing unit containing a pressurized texture surface material for spray-on and direct application of the material in a liquid or semi-liquid form onto a repaired or patched area so that the surrounding patched or repaired surface will be visually and mechanically matched.

Another object of the present invention is to provide a valve assembly for use in an aerosol spray can capable of spraying highly-viscous materials, such as fire suppressant materials, adhesive and bonding materials, and culinary sauces, without clogging or packing like traditional aerosol spray cans when spraying these materials.

The valve assembly comprises a dip tube disposed inside a container. A rod is disposed inside the dip tube so that it may move lengthwise within the dip tube. A sealing member is coupled to the bottom end of the rod, so as to form a tight-seal with the bottom opening of the dip tube when the rod is in an up position, and it exposes the bottom opening of the dip tube to the heavy and particulate material inside the container when the rod is in a down position. A bushing is also coupled to the top opening of the dip tube. Finally, an actuator is coupled to the top end of the rod and the bushing, allowing the user to depress on the actuator, thus lowering the rod to its down position and exposing the bottom opening of the dip tube to the material within the container, and allowing the heavy and particulate material to move up the dip tube and out of the container.

Another embodiment of the valve assembly comprises a dip tube disposed inside the container. An interior tube is disposed inside the dip tube so that it may move lengthwise within the dip tube. There is at least one orifice at the bottom end of the interior tube. A top O-ring is coupled to the interior tube adjacent the at least one orifice to prevent any bypass of the heavy and particulate material into the dip tube, and a bottom O-ring is coupled to the bottom end of the interior tube to seal off the valve assembly when not actuated. The top opening of the dip tube is coupled to a bushing. Finally, an actuator is coupled to the top end of the interior tube, allowing the user to depress on the actuator, thus lowering the interior tube to its down position and exposing the at least one orifice on the interior tube to the material inside the container and allowing the heavy and particulate material to flow up the interior tube and out of the container.

The invention prevents clogging or packing of the valve assembly because the valve opening is at the bottom of the container, as opposed to being at the top, as in traditional aerosol spray cans. The placement of the valve opening at the bottom of the container greatly reduces the clogging or packing of the valve by texture materials having large particulates. This improvement allows the efficient and low-cost spraying of more highly-textured materials, because there is no longer the problem of clogging or packing of the valve opening by the particulates suspended within the texture material.

Other features and advantages of the invention will become apparent from the following detailed description, taken in conjunction with the accompanying drawings that illustrate, by way of example, various features and embodiments of the invention.

BRIEF DESCRIPTION OF THE DRAWINGS

FIG. 4 is a cross-sectional view of a valve assembly in accordance with an embodiment of the present invention.

DETAILED DESCRIPTION OF THE PREFERRED EMBODIMENTS

Figure 1:
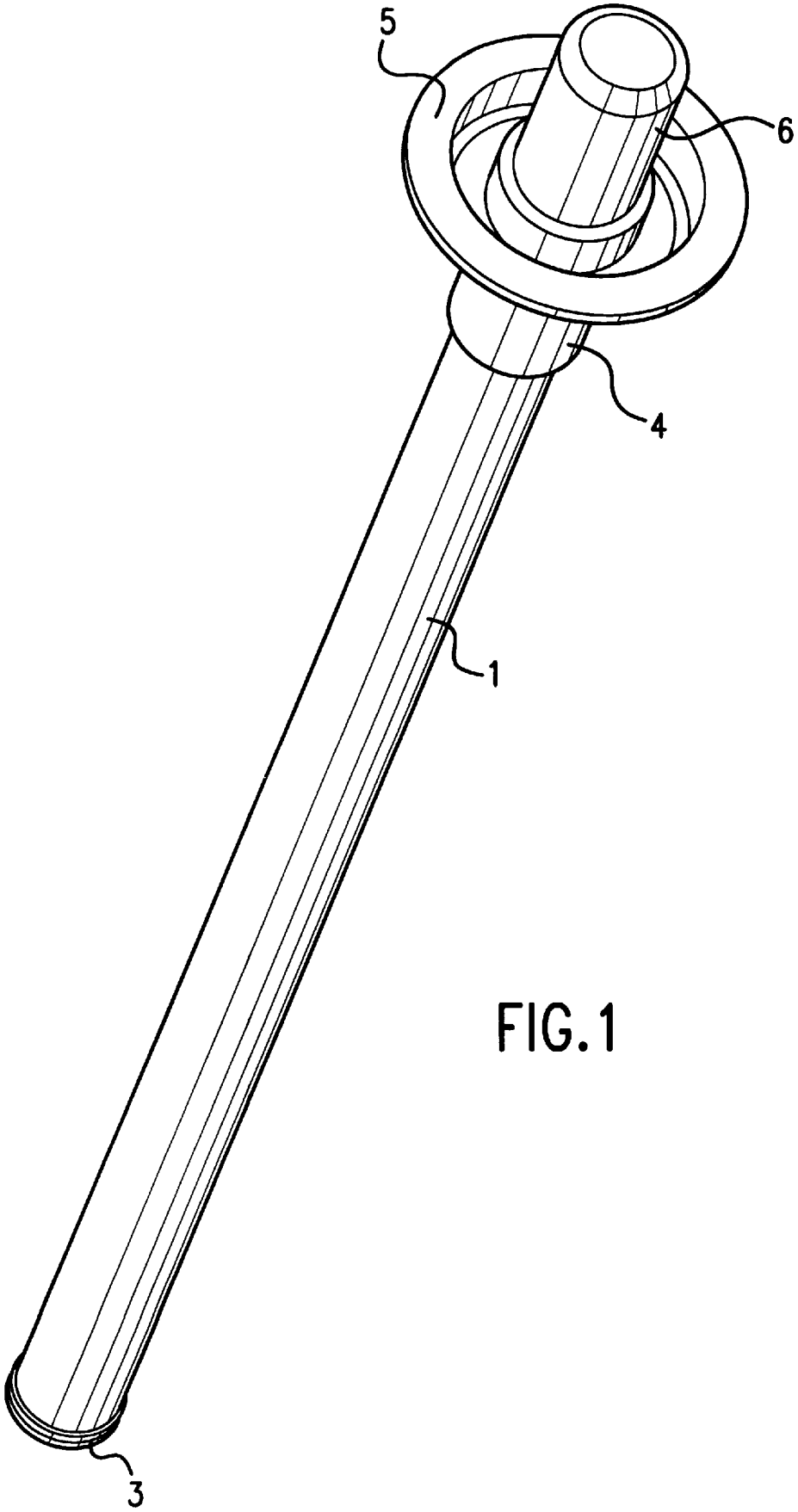
FIG. 1 is a perspective view of a valve assembly in accordance with an embodiment of the present invention.
Figure 3:
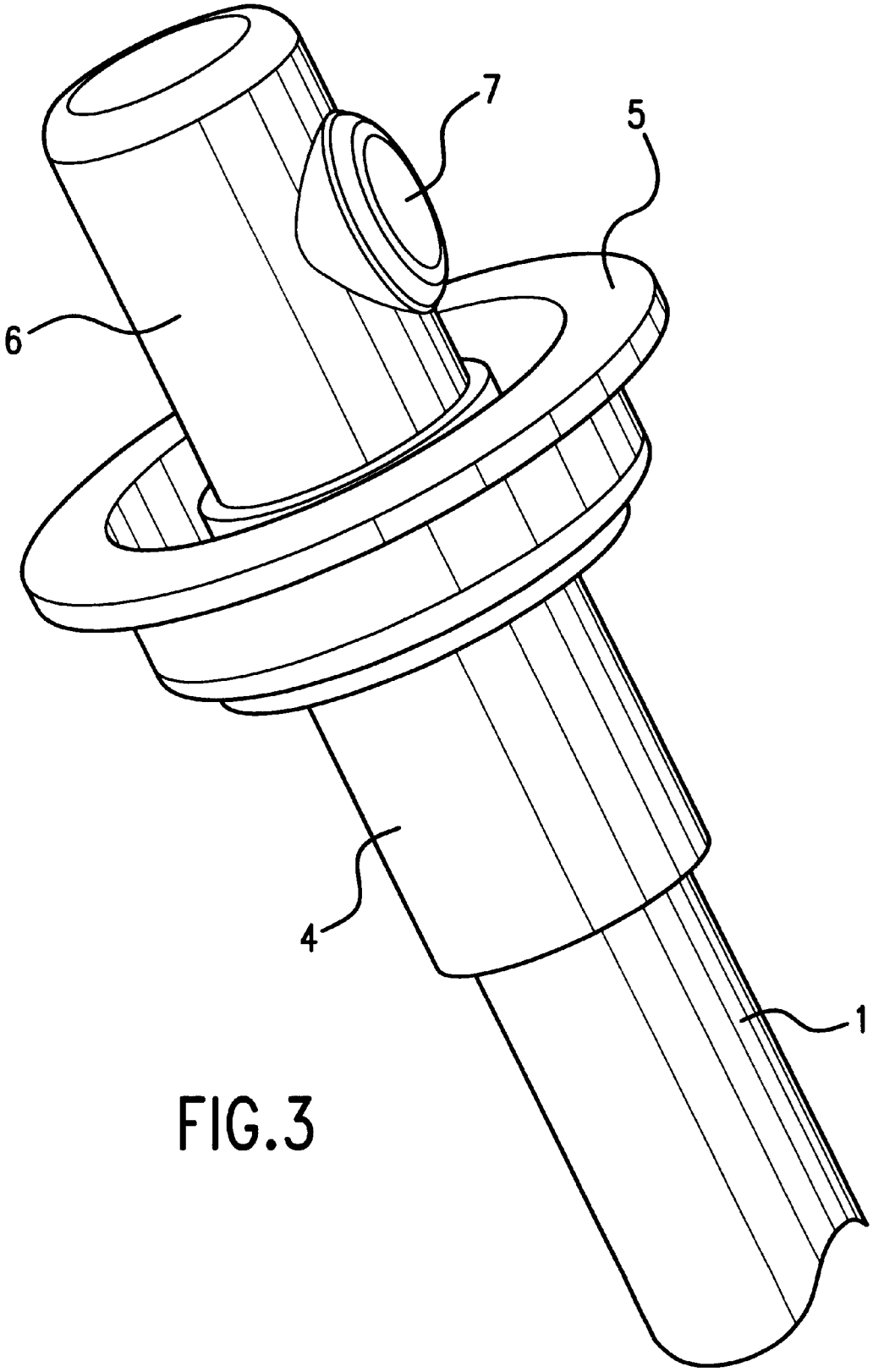
FIG. 3 is a perspective view of a valve assembly in accordance with an embodiment of the present invention.
Figure 5:
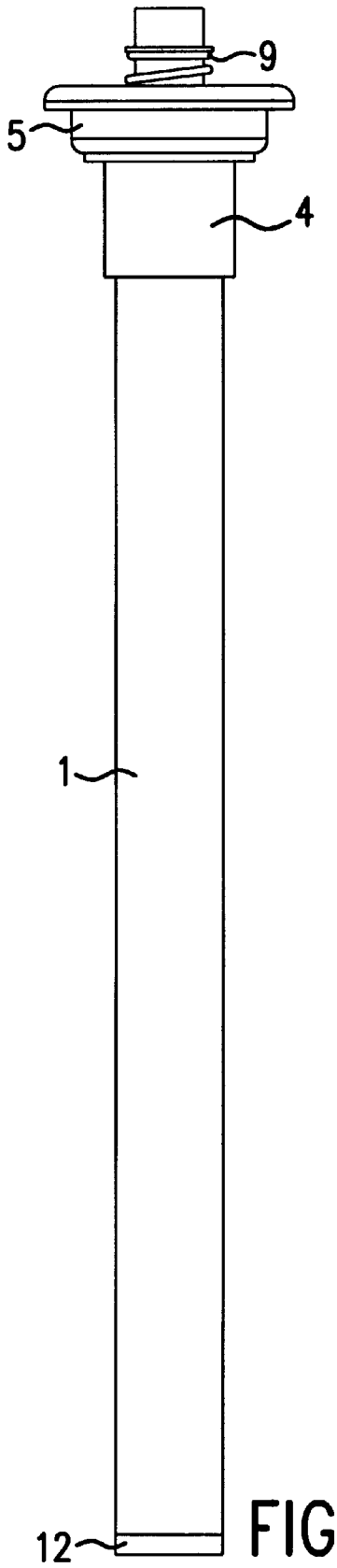
FIG. 5 is a perspective view of a valve assembly in a closed position in accordance with an embodiment of the present invention.
Figure 6:
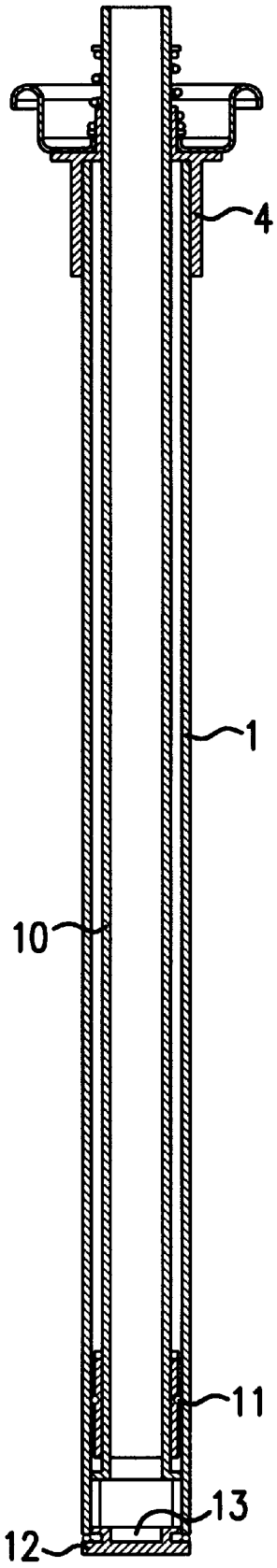
FIG. 6 is a cross-sectional view of a valve assembly in a closed position in accordance with an embodiment of the present invention.
Figure 7A:
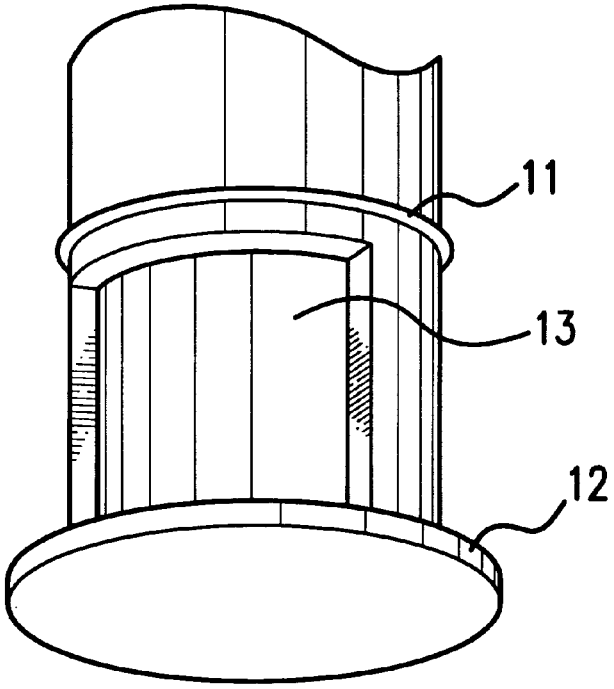
FIG. 7 illustrates perspective views of a valve assembly in accordance with an embodiment of the present invention.
Figure 7B:
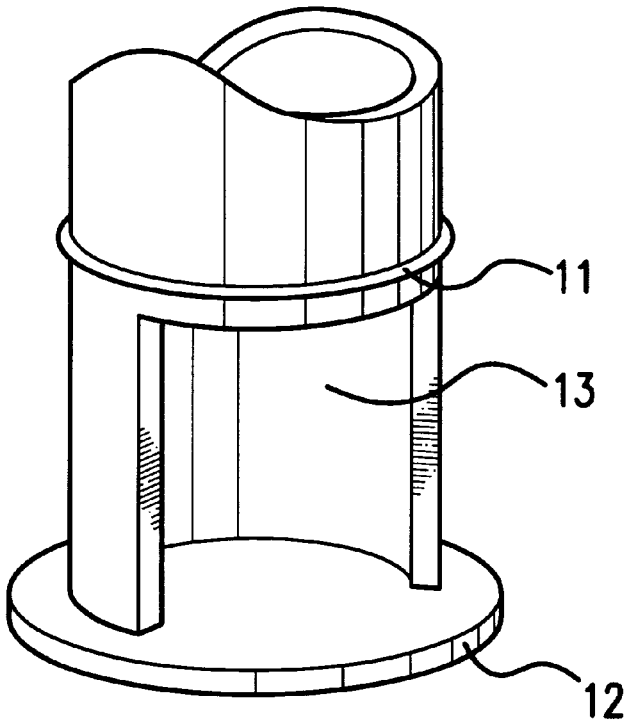
Figure 8:
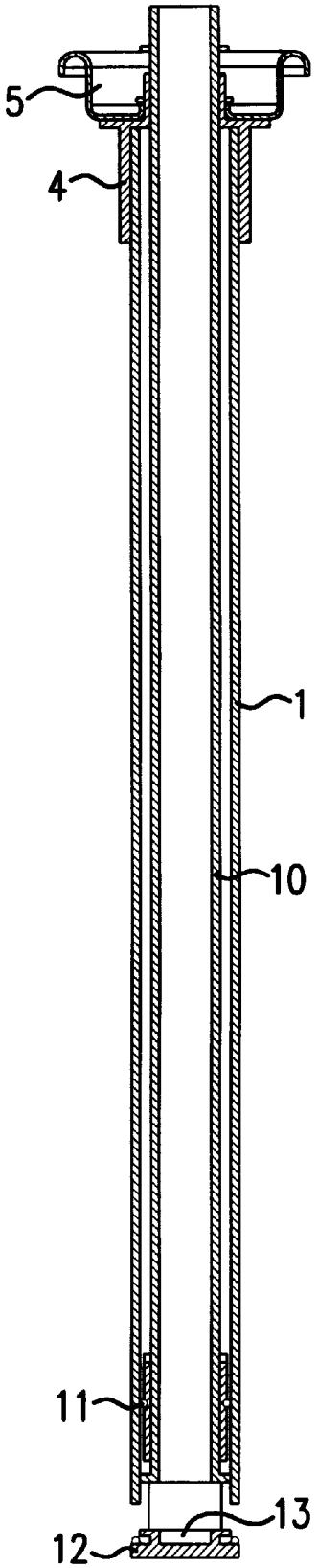
FIG. 8 is a cross-sectional view of a valve assembly in an opened position in accordance with an embodiment of the present invention.
Figure 9:
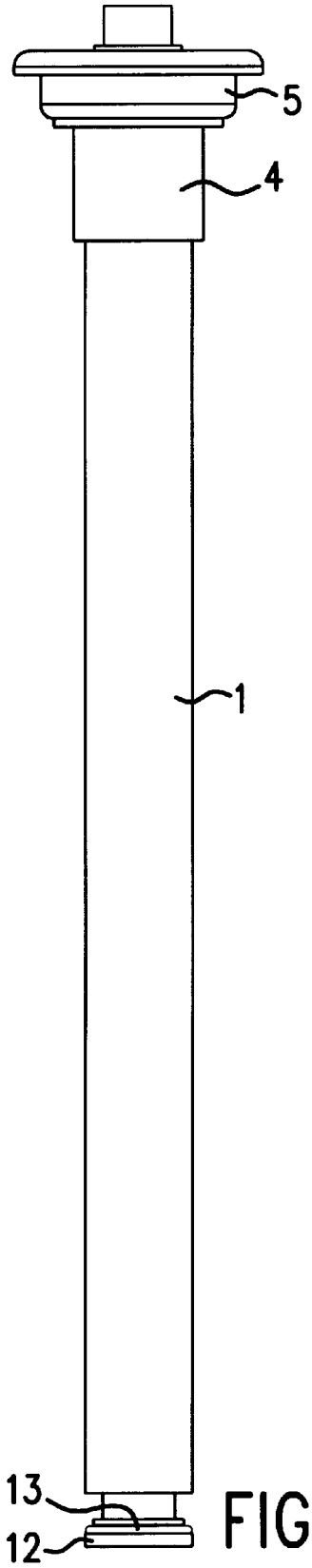
FIG. 9 is a perspective view of a valve assembly in an opened position in accordance with an embodiment of the present invention.

FIGS. 1 and 3 are perspective views of a valve assembly in accordance with an embodiment of the present invention. A dip tube 1 is coupled to a bushing 4, which may also be coupled to a cup 5. An actuator 6 is also coupled to the bushing 4.

Figure 2:
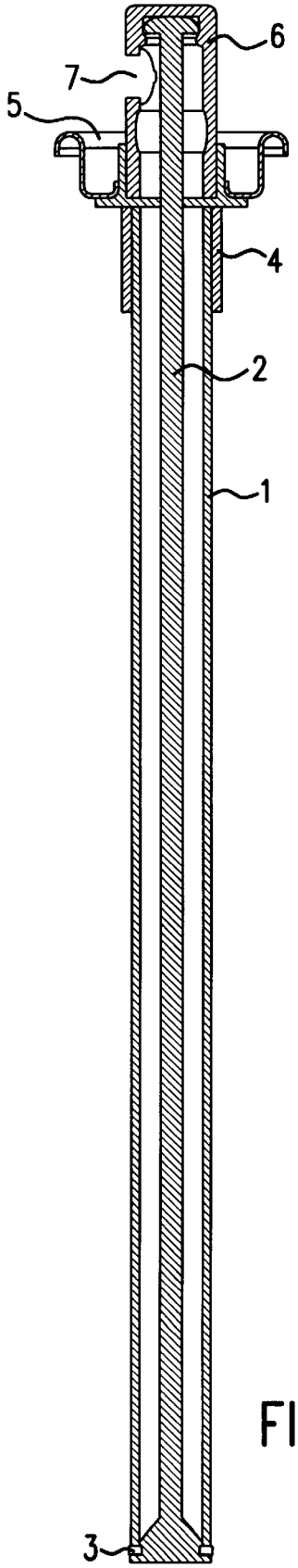
FIG. 2 is a cross-sectional view of a valve assembly in accordance with an embodiment of the present invention.

In FIGS. 2 and 4, an aperture on the actuator 6 forms a nozzle opening 7, in which a dispersing apparatus, such as a nozzle cap or a dispensing tube, may be attached or screwed. A rod 2 is disposed inside the dip tube 1 in a way that allows the rod 2 to move within the dip tube 1 along its length. The actuator 6 is coupled to the top end of the rod 2, so that when the actuator 6 is depressed, the rod 2 moves downward within the dip tube 1. A sealing member 3 is coupled to the bottom end of the rod 2, so that when the rod 2 is in an up position, i.e., the actuator 6 is not depressed, the sealing member 3 forms a tight-seal with the bottom opening of the dip tube 1. However, when the rod 2 is in a down position, i.e., the actuator 6 is depressed, the sealing member 3 exposes the bottom opening of the dip tube 1 to the heavy and particulate material inside the container, and the aerosol within the container will force the texture material through the bottom opening of the dip tube 1, up through the dip tube 1, and out of the container through the nozzle opening 7. The heavy and particulate material may be a variety of sprayable materials, including viscous materials or materials having large particulates, like that of stucco.

The cup 5 acts as a guide to limit how far down the actuator 6 may be depressed, and in turn how far down the rod 2 may travel within the dip tube 1. If the actuator 6 is depressed too far, the bottom end of the rod 2 may come in contact with the bottom surface of the container, which may result in damage to the container. The cup 5 is also adapted to fit securely over the top portion of an aerosol spray can and may also provide a surface for attaching the valve assembly to the aerosol spray can.

The placement of the valve opening at the bottom of the container, as opposed to near the top of the container, as described in the prior references, drastically reduces the clogging and packing of the valve opening as experienced by traditional aerosol spray cans when spraying texture materials containing large particulates, such as stucco. Further descriptions of an example of a heavy and particulate material is disclosed in an accompanying patent application (attorney docket no. 81168-248262) entitled, "Hardenable Texture Material in Aerosol Form," incorporated herein by reference. In addition to being capable of spraying stucco-like materials, the valve assembly is also particularly useful in spraying other types of materials having large particulates or high viscosities, including fire suppressant materials. These materials having large particulates or high viscosities may be dispensed directly from the valve system of an aerosol dispensing container. The aerosol dispensing container is preferably a size that allows it to be hand held and may be operated with one hand.

Ideally, the actuator 6 is made out of an elastic material, such as rubber, so as to allow the retention of the rod 2 in the up position when the actuator 6 is not depressed. The actuator 6 may also be made of a non-elastic material, but there may be a spring member coupled to the bushing 4 and engaging the actuator 6 so as to spring-load the actuator 6. The sealing member 3 should be made of a material, such as rubber, that will allow the sealing member 3 to form a tight-seal with the bottom opening of the dip tube 1 so as to prevent any entry of the texture material and the aerosol carrier into the dip tube 1 when the rod 2 is in the up position, i.e., when the actuator 6 is not being depressed.

FIGS. 5 to 9 show another embodiment of the present invention. A dip tube 1 is coupled to a bushing 4, which may also be coupled to a cup 5. A spring member 9 may be coupled to the bushing 4 to spring-load the actuator 6 engaging the spring member 9 on the bushing 4.

An interior tube 10 with a top end and a bottom end is disposed inside the dip tube I in a way that allows the interior tube 10 to move within the dip tube 1 along its length. The actuator 6 is coupled to the top end of the interior tube 10, so that when the actuator 6 is depressed, the interior tube 10 moves downward within the dip tube 1. There is at least one orifice 13 at the bottom end of the interior tube 10 so as to allow the heavy and particulate material from inside the container to flow up through the interior tube 10 and out of the nozzle opening. A top O-ring 11 is coupled to the interior tube 10 adjacent to and just above the at least one orifice 13 so as to form a seal to prevent any bypass of the heavy and particulate material from the container into the dip tube 1 when the interior tube 10 is in a down position. A bottom O-ring 12 is coupled to the bottom end of the interior tube 10 so as to seal off and close the valve assembly when the interior tube 10 is in an up position.

As described above, the cup 5 may act as a guide so as to limit how far down the actuator 6 may be depressed, as well as provide a surface for attaching the valve assembly to the container.

Figure 10:
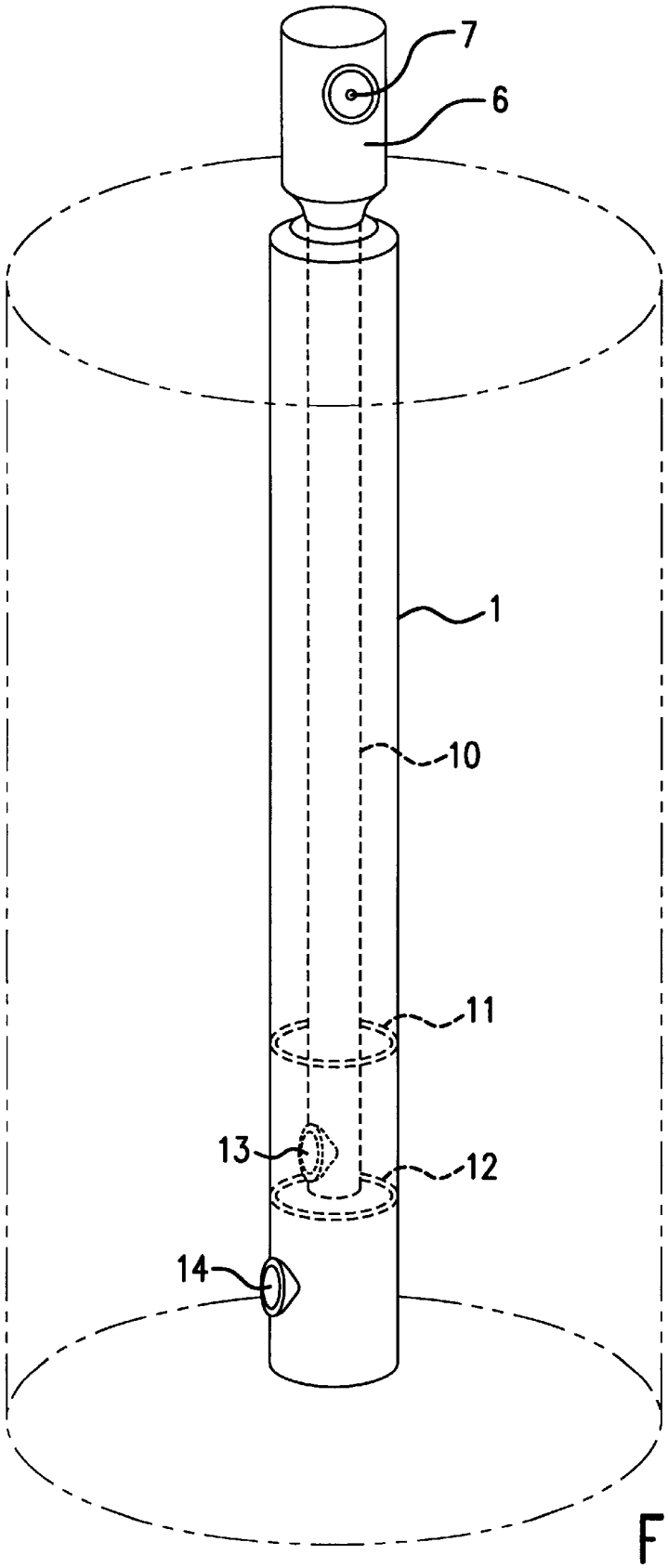
FIG. 10 is a cross-sectional view of a valve assembly in accordance with an embodiment of the present invention.

FIG. 10 shows yet another embodiment of the present invention. There is at least one exterior orifice 14 on the dip tube 1 that is adapted to be in flow alignment with the at least one orifice 13 of the interior tube 10. Therefore, when the actuator 6 is depressed and the interior tube 10 is lowered to its open position, the at least one orifice 13 of the interior tube 10 aligns with the at least one orifice 14 on the dip tube 1 so that the material inside the container may flow through the exterior orifice 14 and into the at least one orifice 13 of the interior tube 10 and up through the interior tube 10 and out of the container through the nozzle opening 7. Similarly, there is a top O-ring 11 and a bottom O-ring 12, as described above, for sealing off the dip tube 1 to prevent any bypass of the heavy and particulate material from the container and for closing the valve assembly.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. In an aerosol system comprising a container, a heavy and particulate material, and a valve assembly that sprays the heavy and particulate material from the container, wherein the valve assembly comprises:

a dip tube with a top opening and a bottom opening disposed inside the container and extending to a bottom of the container without contacting the bottom;

a rod with a top end and a bottom end disposed inside the dip tube adapted to move lengthwise within the dip tube;

a sealing member coupled to the bottom end of the rod, forming a tight-seal with the bottom opening of the dip tube when the rod is in an up position, and opening the bottom opening of the dip tube when the rod is in a down position;

a bushing coupled to the top opening of the dip tube; and an actuator with an aperture forming a nozzle opening coupled to the top end of the rod and the bushing.

2. The valve assembly according to claim 1, wherein the actuator is made of an elastic material.

3. The valve assembly according to claim 1, further comprising:

a spring member coupled to the bushing and engaging the actuator to provide a spring-load for the actuator.

4. The valve assembly according to claim 1, wherein the sealing member is made of rubber.

5. The valve assembly according to claim 1, wherein the bottom end of the rod is adapted to fully close the bottom opening of the dip tube.

6. The valve assembly according to claim 1, further comprising:

a cup coupled to the bushing for attaching the valve assembly to the container.

7. In an aerosol system comprising a container, a heavy and particulate material, and a valve assembly that sprays the heavy and particulate material from the container, wherein the valve assembly comprises:

a dip tube with a top opening and a bottom opening disposed inside the container and extending to a bottom of the container without contacting the bottom;

an interior tube with a top end and a bottom end disposed inside the dip tube adapted to move lengthwise within the dip tube;

at least one orifice at the bottom end of the interior tube;

a top O-ring coupled to the interior tube adjacent to and above the at least one orifice to form a seal to prevent bypass of the heavy and particulate material into the dip tube when the interior tube is in a down position;

a bottom O-ring coupled to the bottom end of the interior tube to seal the valve assembly when the interior tube is in an up position;

a bushing coupled to the top opening of the dip tube; and an actuator with an aperture forming a nozzle opening coupled to the top end of the interior tube.

8. The valve assembly according to claim 7, further comprising:

a spring member coupled to the bushing and surrounding the top end of the interior tube and engaging the actuator to provide a spring-load for the actuator.

9. The valve assembly according to claim 7, further comprising:

a cup coupled to the bushing for attaching the valve assembly to the container.

10. The valve assembly according to claim 8, wherein a spring member retainer is coupled to the top end of the interior tube to retain the spring member on the interior tube.

11. In an aerosol system comprising a container, a heavy and particulate material, and a valve assembly that sprays the heavy and particulate material from the container, wherein the valve assembly comprises:

a dip tube having a top opening and disposed inside the container and extending into the container;

an interior tube with a top end and a bottom end disposed inside the dip tube adapted to move lengthwise within the dip tube;

at least one orifice at the bottom end of the interior tube;

a top O-ring coupled to the interior tube adjacent to and above the at least one orifice to form a seal to prevent bypass of the heavy and particulate material into the dip tube when the interior tube is in a down position;

a bottom O-ring coupled to the bottom end of the interior tube to seal the valve assembly when the interior tube is in an up position;

at least one exterior orifice on the dip tube adapted to be in flow alignment with the at least one orifice of the interior tube when the interior tube is in the down position;

a bushing coupled to the top opening of the dip tube; and an actuator with an aperture forming a nozzle opening coupled to the top end of the interior tube.

12. The valve assembly according to claim 11, further comprising:

a spring member coupled to the bushing and surrounding the top end of the interior tube and engaging the actuator to provide a spring-load for the actuator.

13. The valve assembly according to claim 11, further comprising:

a cup coupled to the bushing for attaching the valve assembly to the container.

14. The valve assembly according to claim 12, wherein a spring member retainer is coupled to the top end of the interior tube to retain the spring member on the interior tube.

15. A method of applying a heavy and particulate material onto a surface area to form a textured surface, the method comprising the steps of:

storing the heavy and particulate material in a fluid-tight aerosol dispensing container having a valve assembly for application to the surface area surrounded by an irregular texture material, wherein the valve assembly comprises, a dip tube with a top opening and a bottom opening disposed inside the container and extending to a bottom of the container without contacting the bottom, a rod with a top end and a bottom end disposed inside the dip tube adapted to move lengthwise within the dip tube, a sealing member coupled to the bottom end of the rod, forming a tight-seal with the bottom opening of the dip tube when the rod is in an up position, and opening the bottom opening of the dip tube when the rod is in a down position, a bushing coupled to the top opening of the dip tube, and an actuator coupled to the top end of the rod and the bushing, wherein the fluid-tight aerosol dispensing container has a nozzle opening for dispensing the heavy and particulate material using a pressure from the fluid-tight aerosol dispensing container in the form of an aerosol spray; and selectively dispensing the heavy and particulate material onto the surface area such that the heavy and particulate material forms a layer having a bumpy, irregular surface texture after being dispensed that matches and is compatible with the irregular texture material surrounding the surface area.

16. A method of applying a heavy and particulate material onto a surface area to form a textured surface, the method comprising the steps of:

storing the heavy and particulate material in a fluid-tight aerosol dispensing container having a valve assembly for application to the surface area surrounded by an irregular texture material, wherein the valve assembly comprises, a dip tube with a top opening and a bottom opening disposed inside the container and extending to a bottom of the container without contacting the bottom, an interior tube with a top end and a bottom end disposed inside the dip tube adapted to move lengthwise within the dip tube, at least one orifice at the bottom end of the interior tube, a top O-ring coupled to the interior tube adjacent to and above the at least one orifice to form a seal to prevent bypass of the heavy and particulate material into the dip tube when the interior tube is in a down position, a bottom O-ring coupled to the bottom end of the interior tube to seal the valve assembly when the interior tube is in an up position, a bushing coupled to the top opening of the dip tube, and an actuator coupled to the top end of the interior tube, wherein the fluid-tight aerosol dispensing container has a nozzle opening for dispensing the heavy and particulate material using a pressure from the fluid-tight aerosol dispensing container in the form of an aerosol spray; and selectively dispensing the heavy and particulate material onto the surface area such that the heavy and particulate material forms a layer having a bumpy, irregular surface texture after being dispensed that matches and is compatible with the irregular texture material surrounding the surface area.

17. A method of applying a heavy and particulate material onto a surface area to form a textured surface, the method comprising the steps of:

storing the heavy and particulate material in a fluid-tight aerosol dispensing container having a valve assembly for application to the surface area surrounded by an irregular texture material, wherein the valve assembly comprises, a dip tube having a top opening and disposed inside the container and extending into the container, an interior tube with a top end and a bottom end disposed inside the dip tube adapted to move lengthwise within the dip tube, at least one orifice at the bottom end of the interior tube, a top O-ring coupled to the interior tube adjacent to and above the at least one orifice to form a seal to prevent bypass of the heavy and particulate material into the dip tube when the interior tube is in a down position, a bottom O-ring coupled to the bottom end of the interior tube to seal the valve assembly when the interior tube is in an up position, at least one exterior orifice on the dip tube adapted to be in flow alignment with the at least one orifice of the interior tube when the interior tube is in the down position, a bushing coupled to the top opening of the dip tube, and an actuator coupled to the top end of the interior tube, wherein the fluid-tight aerosol dispensing container has a nozzle opening for dispensing the heavy and particulate material using a pressure from the fluid-tight aerosol dispensing container in the form of an aerosol spray; and selectively dispensing the heavy and particulate material onto the surface area such that the heavy and particulate material forms a layer having a bumpy, irregular surface texture after being dispensed that matches and is compatible with the irregular texture material surrounding the surface area.

* * * * *